United States Patent [19]

Ray

[11] 4,074,818

[45] Feb. 21, 1978

[54] LOADING/UNLOADING CRANE WITH BUOYANT COUNTERWEIGHT SYSTEM

[76] Inventor: Louis F. Ray, P.O. Box 14702, Baton Rouge, La. 70808

[21] Appl. No.: 664,119

[22] Filed: Mar. 5, 1976

[51] Int. Cl.[2] ..... B63B 27/00; B66C 23/52

[52] U.S. Cl. ..... 214/13; 212/3 R; 212/48; 212/56; 212/63

[58] Field of Search ..... 212/3, 56, 48–49, 212/63; 214/13–15 R, 141

[56] References Cited

U.S. PATENT DOCUMENTS

| | | | |
|---|---|---|---|
| 734,974 | 7/1903 | Shoosmith | 212/56 |
| 3,402,824 | 9/1968 | Zweifel | 212/81 |
| 3,752,326 | 8/1973 | Levingston | 212/48 |
| 3,945,508 | 3/1976 | Colin | 214/13 |

FOREIGN PATENT DOCUMENTS

| | | | |
|---|---|---|---|
| 682,029 | 9/1929 | France | 212/3 |
| 12,734 of | 1849 | United Kingdom | 212/56 |
| 19,166 of | 1893 | United Kingdom | 212/49 |

*Primary Examiner*—Trygve M. Blix
*Assistant Examiner*—R. B. Johnson
*Attorney, Agent, or Firm*—Sughrue, Rothwell, Mion, Zinn and Macpeak

[57] ABSTRACT

A crane assembly mounted on a buoyant barge has a vertical column with a cross boom, the boom including outer extremities. A trolley is movably mounted on the boom, and has lift means for engagement with articles to be loaded and unloaded. A buoyant counterweight is attached to one of the extremities of the boom by a cable of fixed length, and the other extremity of the boom is secured to the loading and unloading site. The counterweight resists tilt moments on the boom responsive to movement of the weight of the lifted article along the boom, and overturn is prevented in other positions of the article weight by the attachment of the boom to the site.

5 Claims, 7 Drawing Figures

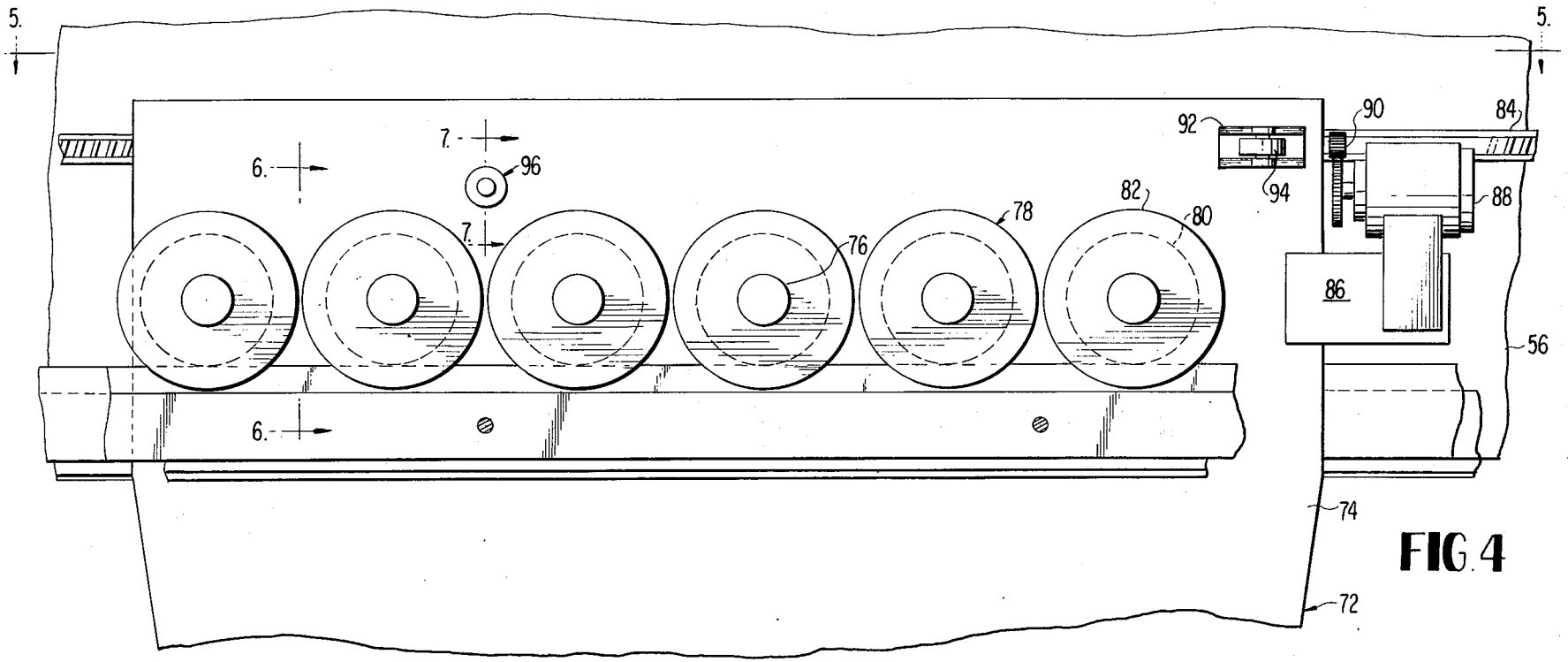
FIG. 4
FIG. 5
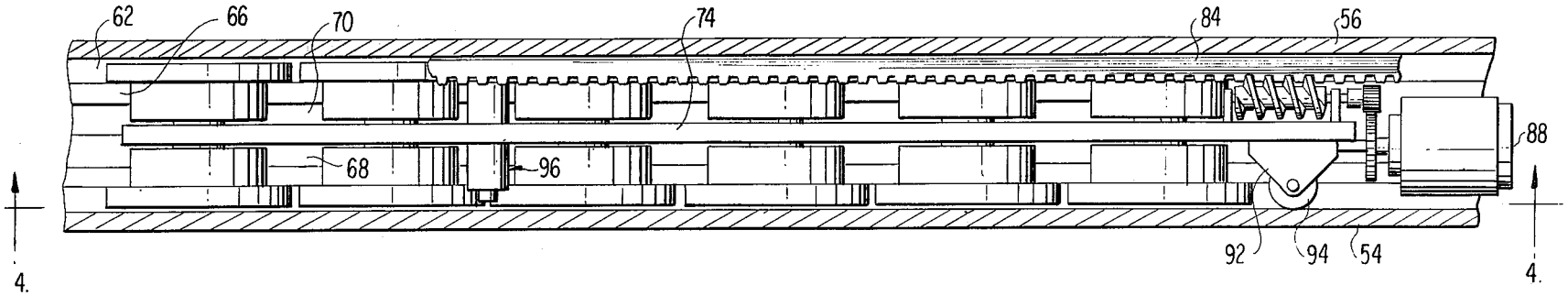

LOADING/UNLOADING CRANE WITH BUOYANT COUNTERWEIGHT SYSTEM

CROSS-REFERENCE TO RELATED APPLICATION

This invention involves subject matter closely related to that showh in the application entitled CABLE STAY CRANE, Ser. No. 661,063, filed Feb. 24, 1976.

BACKGROUND OF THE INVENTION

1. Field of the Invention

This invention pertains to counterweight means incorporated in a floating crane, to maintain the crane in stable condition during lift operations, and to avoid dangerous tilting thereof.

2. Statement of the Prior Art

Prior proposals relating to avoidance of overturn of floating cranes, involving movable counterweight systems, have generally proven unsuccessful.

SUMMARY OF THE INVENTION

Numerous objects and advantages of the present invention are shared in common by this invention and that shown in the aforesaid prior application. In addition to these advantages, the present invention provides a counterweight system which operates in response to the weight factor applied to the crane and is substantially automatic in operation.

The apparatus hereof employs inexpensive and readily available counterweight components, and by comparison with other waterborne cranes, is of low initial cost.

The invention hereof proposes a cable stay crane mounted on a tower or column assembly, wherein the column extends vertically from a waterborne barge. Cable stays extend from longitudinally spaced locations along the crane boom or gantry, and are secured to the column above the gantry. At one extremity of the gantry a flexible connector extends to a floating counterweight barge. A cable at the opposite extremity of the gantry is variable in length and is secured to the loading or unloading site —in some instances another vessel.

Other and further objects and advantages of the invention will become apparent to those skilled in the art from a consideration of the following specification when read in conjunction with the annexed drawings.

BRIEF DESCRIPTION OF THE DRAWINGS

FIG. 4 is a longitudinal cross-section, substantially on line 4—4 of FIG. 5, showing details of the boom trolley and actuating means therefor;

FIG. 5 is a sectional view from above, on line 5—5 of FIG. 4, looking in the direction of the arrows;

DESCRIPTION OF THE PREFERRED EMBODIMENT

Figure 1:
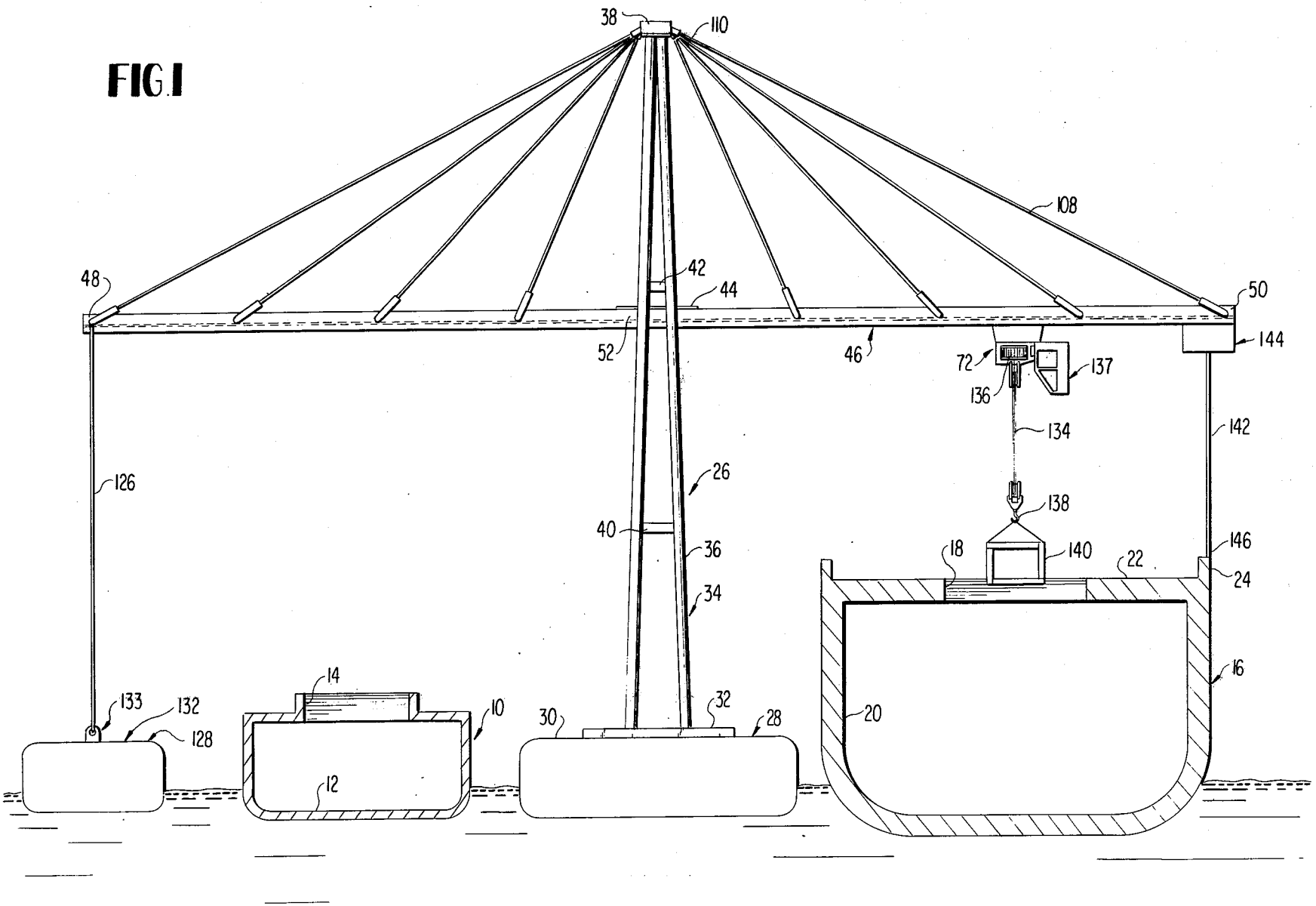
FIG. 1 is an assembly view showing a typical environment of employment of a counterweight system and crane assembly according to this invention, certain components being shown in cross-section.

Under circumstances periodically encountered, it is necessary or desirable to load or unload watercraft with a float mounted crane. Such cranes are notoriously subject to tipping over during use, often with substantial loss of materials and great danger to operating personnel. In FIG. 1, a typical load/unload situation is shown. There, a loaded vessel 10 has been positioned for unloading of material from its cargo area 12 through a hatch 14. Afloat nearby is a second vessel 16 to which the cargo is to be transferred. This vessel also has an open hatch 18 leading to its hold 20, with a surrounding deck 22 and side post 24.

A cable stay crane assembly 26 is fixedly mounted on a buoyant crane barge 28. The barge 28 has a top deck 30 on which is centered a mounting plate 32. A tower or column assembly 34 comprising a series of posts 36 projects upwardly from the plate 32, and posts converge and are joined together at a top portion 38 of the column assembly. At intermediate locations, cross-braces 40, 42 connect the posts and serve to rigidify the column. A boom mounting plate 44 is also secured to the posts at an elevated position between the plate 32 and top portion 38.

The gantry or boom assembly hereof is generally identified in the drawings by reference numeral 46. The boom includes opposite outer extremities 48 and 50, and is secured to the boom plate 44 at its mid-length portion 52.

The boom includes a pair of confronting, spaced-apart, elongated side plates, 54, 56 connected at their tops by a channel bar 58. Along their lower inner surfaces, the side plates each have a short track member 60, 62, and a tall track member 64, 66. Resilient skirts 68 and 70 project inwardly from the walls 54 and 56 to form a dirt seal.

A trolley assembly 72 includes a vertical hanger arm 74 which is suspended partially within the truss and extends downwardly thereof through the seals 68 and 70. The hanger arm has a plurality of cross axles 76 extending therethrough at spaced intervals, and these carry rotatable wheels 78. Each wheel 78 has an inner portion 80 and an enlarged outer portion 82. The inner portions ride on the short track members, and the outer portions ride on the tall track members. Thus, the trolley is movably mounted with respect to the truss.

Movement of the trolley involves an elongated rack gear 84 mounted to extend substantially the full length of the wall 56. A bracket 86 on the hanger arm 74 carries a motor 88 which has a worm gear 90 in driving relation to the rack gear 84. The motor is reversible, and thereby allows for movement of the trolley in either horizontal direction.

The hanger arm also has a housing 92 in which a roller 94 is rotatably mounted. This stabilizes the trolley arm, and insures a mesh relationship of the gearing.

Figure 7:
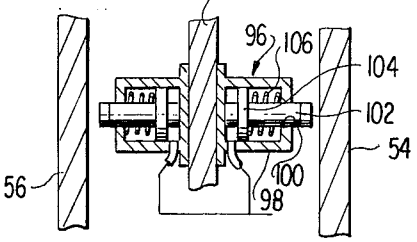
FIG. 7 is an enlarged sectional view of a stop mechanism, taken on line 7—7 of FIG. 5.
Figure 6:
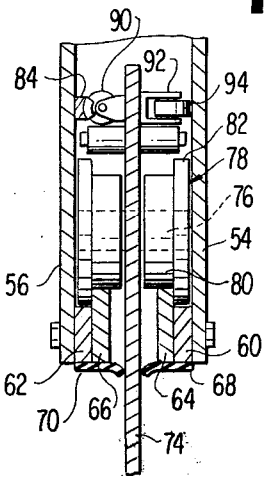
FIG. 6 shows the details of one of the trolley wheel assemblies.

FIG. 7 particularly illustrates a lock mechanism 96 actuated, when required, to clamp the trolley at a selected position relative to the truss. This comprises a pair of cup-like lock housings 98 having openings 100 therein. Disposed within these housings and extended through the openings are shafts 102. Collars 104 are fixed on the shafts, and springs 106 serve to urge the shafts inwardly against the collar. Hydraulic or other conventional actuation means are employed to urge the shafts outwardly, pressing the ends of the shafts against the walls when desired. In such position, further movement of the trolley cannot occur.

Figure 2:
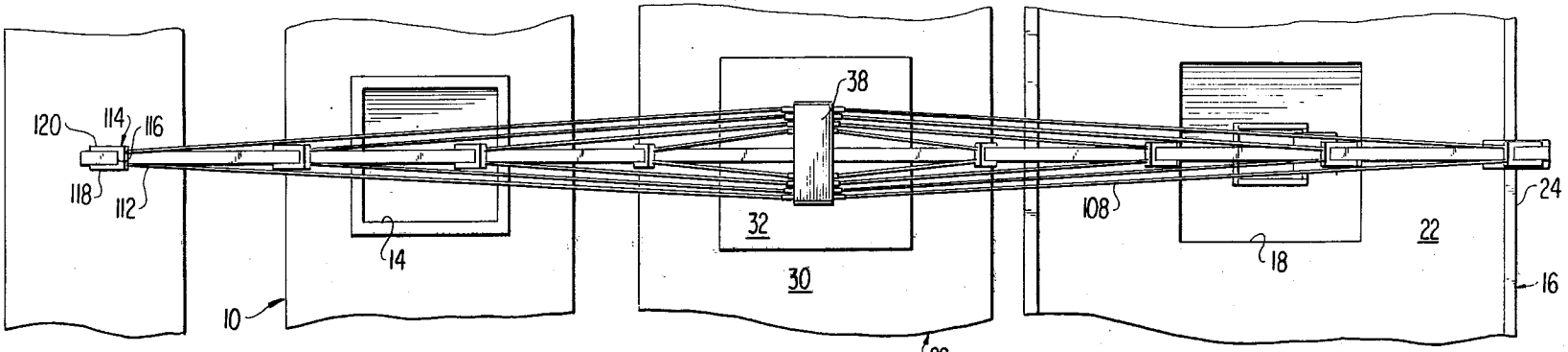
FIG. 2 is a top plan view of the apparatus of FIG. 1.
Figure 3:
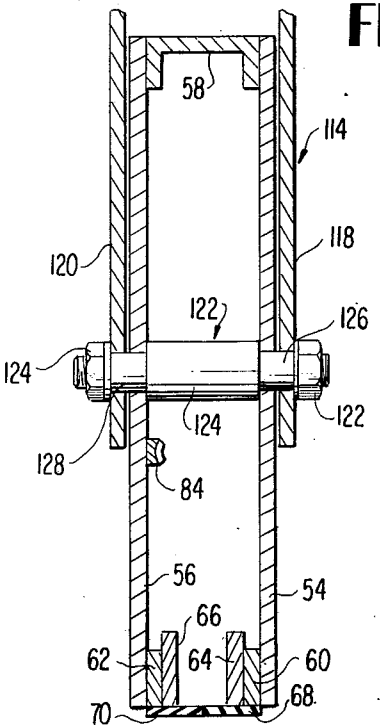
FIG. 3 is an enlarged, vertical cross-section through the boom, illustrating a cable stay connection thereto.

The boom is essentially supported by cable stay means constituting an important, but uncritical, feature of the present invention. A series of cables 108 have upper ends 110, fixedly secured by conventional anchor means to the top portion 38 of the tower. In FIGS. 2 and 3, it is illustrated that the lower ends 112 are connected to U brackets 114. The brackets include bright portions 116, and spaced arms 118, 120. A cross piece 122 has an enlarged central section 124, at reduced ends 126, 128 which project through co-aligned openings in the side plates 54, 56 and arms 118, 120. The ends are threaded to receive lock nuts 122 and 124, thereby pivotally connecting the cable ends to the boom. The drawings amply indicate the lateral outward spacing of the cable stays. The cable stay principle has the characteristic of equivalent distribution of the forces on the boom and of transfer of downward moments applied thereto.

The boom or gantry 46 may be assumed for purposes of description herein to be normally in balance, forces at rest being equivalently distributed from side to side. In FIG. 1, at the extremity 48 of the boom, a cable 126 of fixed length is secured. A buoyant counterweight barge 128 has a top deck 132 with a cable connecting device 133 therein. The fixed length cable 126 is connected to the device 133, for a purpose appearing below.

Depending from the trolley assembly 72 is a lift cable 134. The cable 134 is connected at its top to a winch 136 on the hanger arm 72. An operator's cab 137 is associated with the trolley arrangement. The cable carries a connection hook 138, or the like, to position a lift connector member for the article 140 to be removed from the vessel 10.

Extending between the second vessel 16 (or a loading dock or pier) and the extremity 50 of the boom is a second cable 142 of adjustable length. On said end of the boom is a mechanism 144 of optional, variable design to house the cable connection and to adjustably vary the length thereof responsive to conditions. The cable 142 has a lower end 146 fixedly secured to the outer side post 24 of the second vessel.

In operation, it should be assumed that the vessel 10 is initially loaded with articles 140 to be transferred to the vessel 16. With the crane in stable condition, the tower 34 is vertical, and the boom 46 horizontal. The counterweight barge 128 is afloat, and the cable 142 adjusts itself to compatible position and length. The crane operator then moves the trolley 72 over the loaded vessel 10 and lowers the cable 134 to engage the hook 138 with the cargo 140. As the cargo is lifted, the boom horizontal position is maintained by the buoyant effect of the counterweight barge, and the respective cable. The equilibrium of the crane is maintained and overturning moment of the crane barge 28 resisted by the counterweight barge 128, and the vessel 16. In FIG. 1, if a load is lifted by the lift cable over the loaded vessel 10, downward forces on the boom on the counterweight side of the column 34 are transmitted through the cables 108 to the opposite side of the boom, and then resisted by maintainence of the cable 142 in a selected position (the locking of the cable at said length being accomplished either through automated sensor means or through manual controls operated from the cab 137). In such condition, the vessel to be loaded effectively functions as a counterweight inasmuch as any tendency to tilt would tend to raise the vessel. As the load is moved on the trolley in the direction of the vessel 16, overturning moments are applied to the boom in the opposite direction, and as this occurs, this force is transmitted through the cable stays and boom to the cable 126. Overturning is of course resisted there by the substantial weight of the counterweight barge 128. As the vessel 16 is filled with cargo, its increased weight causes it to ride lower in the water, but compensation for this is accomplished through variance in the length of the cable 142 either automatically or by manual control.

I claim:

1. A loading/unloading crane assembly for transfer of cargo from a loaded first floating vessel to a second floating vessel, the crane assembly comprising:

a floating crane barge;

a column assembly extending vertically from the crane barge, the column assembly including a top portion, and a base;

a horizontal boom, connected at an intermediate point thereof to the column assembly between the top portion and the base, and having opposite outer extremities on either side of the column assembly;

means securing the boom to the top portion of the column at longitudinally spaced locations;

a floating counterweight barge secured to the boom adjacent one outer extremity thereof by a first cable of fixed length;

the first loaded vessel being located between the crane barge and the counterweight barge;

a second cable of adjustable length securing the opposite outer extremity of the boom to the second vessel; and movable trolley means on the boom, including a vertically movable hoist cable with cargo engagement means, for withdrawal of cargo from the loaded first vessel, movement through said intermediate point, and placement of the cargo in the second vessel, the cable of adjustable length being lengthened as the second vessel takes on cargo.

2. The invention of claim 1, wherein:

said means securing the boom to the top portion of the column comprise a series of cables.

3. The invention of claim 1, wherein:

said means securing the boom to the top portion of the cable comprise a series of cables; and the cables are pivotally connected to the boom.

4. The invention of claim 1, and:

adjustment means to selectively vary the length of the second cable.

5. The invention of claim 1, and:

an operator's cab on said trolley.

* * * * *